US007909218B2

(12) United States Patent
Jiang

(10) Patent No.: US 7,909,218 B2
(45) Date of Patent: Mar. 22, 2011

(54) SAFETY APPARATUS FOR SPRING POWERED STAPLERS

(76) Inventor: Peigen Jiang, Sammamish, WA (US)

( * ) Notice: Subject to any disclaimer, the term of this patent is extended or adjusted under 35 U.S.C. 154(b) by 303 days.

(21) Appl. No.: 11/962,104

(22) Filed: Dec. 21, 2007

(65) Prior Publication Data

US 2009/0159632 A1 Jun. 25, 2009

(51) Int. Cl.
*B25C 5/00* (2006.01)

(52) U.S. Cl. ..... 227/132; 227/8; 227/120; 227/134

(58) Field of Classification Search ..... 227/132, 227/134, 120, 8

See application file for complete search history.

(56) References Cited

U.S. PATENT DOCUMENTS

| | | | | |
|---|---|---|---|---|
| 2,326,540 | A * | 8/1943 | Krantz | 173/31 |
| 2,493,640 | A * | 1/1950 | Peterson | 227/132 |
| 5,356,063 | A * | 10/1994 | Perez | 227/132 |
| 5,699,949 | A * | 12/1997 | Marks | 227/132 |
| 6,789,719 | B2 * | 9/2004 | Shor | 227/132 |
| 7,097,086 | B2 * | 8/2006 | Joyce et al. | 227/120 |
| 7,097,088 | B2 * | 8/2006 | Shor | 227/132 |
| 7,121,444 | B2 * | 10/2006 | Joyce | 227/132 |
| 7,243,832 | B2 * | 7/2007 | Jiang | 227/120 |
| 7,299,960 | B1 * | 11/2007 | Marks et al. | 227/132 |
| 7,387,227 | B1 * | 6/2008 | Jiang et al. | 227/8 |
| 7,395,955 | B2 * | 7/2008 | Zins et al. | 227/132 |
| 7,404,507 | B2 * | 7/2008 | Marks | 227/132 |
| 7,464,844 | B2 * | 12/2008 | Kamins et al. | 227/132 |
| 7,513,406 | B2 * | 4/2009 | Marks | 227/120 |
| 2006/0186170 | A1 * | 8/2006 | Marks | 227/120 |
| 2007/0023473 | A1 * | 2/2007 | Jiang | 227/132 |
| 2007/0034664 | A1 * | 2/2007 | Jiang | 227/132 |
| 2009/0050666 | A1 * | 2/2009 | Jiang | 227/120 |
| 2009/0159632 | A1 * | 6/2009 | Jiang | 227/8 |

* cited by examiner

*Primary Examiner* — Rinaldi I. Rada
*Assistant Examiner* — Michelle Lopez

(57) ABSTRACT

This invention provides a safety apparatus for a spring powered stapler, the safety apparatus comprising a lock plate holding up a power spring for storing energy when in a first position, and releasing the power spring when the lock plate being moved substantially horizontally to a second position, a safety pin substantially vertically movable between a third and fourth position, the safety pin being in the third position when the stapler is not pressed against an object, and the safety pin being in the fourth position when the stapler is pressed against an object, wherein when in the third position, the safety pin stops the lock plate from being moved to the second position, and when in the fourth position, the safety pin makes room for the lock plate to be moved to the second position.

14 Claims, 4 Drawing Sheets

SAFETY APPARATUS FOR SPRING POWERED STAPLERS

BACKGROUND

The present invention relates generally to staplers, and more specifically, to safety apparatus for spring-powered staplers.

A key for a staple to have good penetration is its entry speed. A spring powered stapler uses a spring to store energy. Upon a release of the stored spring energy, a staple can be driven out at a great speed. However, a fast exit staple may shoot like a bullet which poses a safety concern for the spring powered stapler. As such, what is needed is a safety apparatus for the spring powered stapler.

SUMMARY

In view of the foregoing, the present invention provides a safety apparatus for a stapler having a power spring for storing energy as well as urging a driving blade to expel a staple upon releasing the stored energy, the safety apparatus comprising a lock plate having a top section holding up the power spring for storing energy when the top section of the lock plate being in a first position, and releasing the power spring when the top section of the lock plate being moved substantially horizontally to a second position, a first spring for urging the top section of the lock plate to the first position, a safety pin substantially vertically movable between a third and fourth position, the safety pin being in the third position when the stapler is not pressed against an object for being stapled, and the safety pin being in the fourth position when the stapler is pressed against an object for being stapled, and a second spring for urging the safety pin to the fourth position, wherein when in the third position, the safety pin stops the lock plate from being moved to the second position, and when in the fourth position, the safety pin makes room for the lock plate to be moved to the second position.

The construction and method of operation of the invention, however, together with additional objects and advantages thereof will be best understood from the following description of specific embodiments when read in connection with the accompanying drawings.

BRIEF DESCRIPTION OF THE DRAWINGS

The drawings accompanying and forming part of this specification are included to depict certain aspects of the invention. A clearer conception of the invention, and of the components and operation of systems provided with the invention, will become more readily apparent by referring to the exemplary, and therefore non-limiting, embodiments illustrated in the drawings, wherein like reference numbers (if they occur in more than one view) designate the same elements. The invention may be better understood by reference to one or more of these drawings in combination with the description presented herein. It should be noted that the features illustrated in the drawings are not necessarily drawn to scale.

FIG. 2B is a side partial sectional view of the spring powered stapler of FIG. 1 which is prevented from ejecting a staple when a safety pin is not pushed in.

DESCRIPTION

The present invention provides a safety apparatus to a spring powered stapler. The safety apparatus is to ensure when the spring powered stapler is not firmly pressed against an object, attempts to operate the spring powered stapler will not result in any expulsion of staples.

Figure 1:
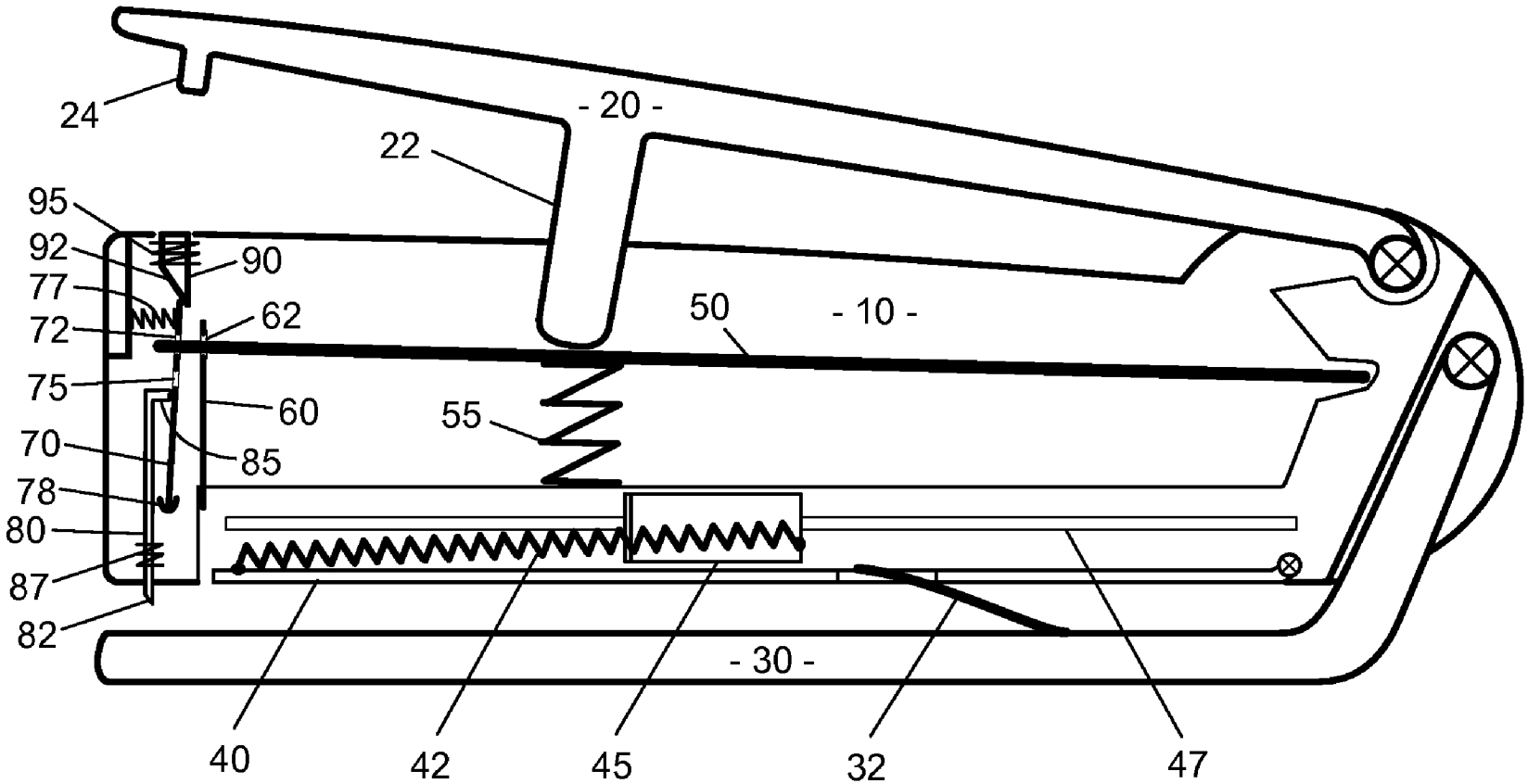
FIG. 1 is a side partial sectional view of a spring powered stapler with a safety apparatus in a resting position according to one embodiment of the present invention.

FIG. 1 is a side partial sectional view of a spring powered stapler having a safety apparatus in a resting position according to one embodiment of the present invention. The spring powered stapler comprises a housing body 10, a handle 20, a power spring 50, a return spring 55, a driving blade 60, and a release assembly including a release plate 70, a safety pin 80 and a release block 90. There is a first push-down rod 22 affixed on the handle 20 for urging the middle section of the power spring 50 to bend downward for storing spring energy when the handle 20 is pressed down. There is also a second push-down rod 24 affixed on the handle 20 closer to the front of the handle 20 for forcing the release block 90 to move downward when the handle 20 is pressed down. A front section of the power spring 50 engages the driving blade 60 through an opening 62 thereon. A rear end of the power spring 50 is confined by the housing body 10 and cannot move either vertically or backwardly. The lock plate 70 has at least one locking hole 72 and a safety-pin hole 75. The lock plate 70 is stopped by a fixture on the housing body 10 (not shown) from swing further downward, so that the power spring can be held up. When a front end of the power spring 50 is inserted in the locking hole 72, the power spring is locked thereby in a high position. The lock plate 70 is pushed frontward by a wedge-like surface 92 of the release block 90 when the release block 90 is pressed down by the handle 20. When the lock plate 70 is pushed frontward enough, the locking hole 72 thereon will disengage with the power spring 50. Then the power spring 50 will force the driving blade 60 to move downward to expel a staple (not shown) out of the staple feeding track.

Referring again to FIG. 1, a bottom end of the lock plate 70 is confined by a groove 78 which is affixed on the housing body 10. A top end of the lock plate 70 is pushed backward by a lock-plate push spring 77. When the top end of the lock plate 70 is pushed to a backward position, the front end of the power spring 50 is inserted into the locking hole 72 of the lock plate, so that the lock plate 70 prevents the power spring from releasing energy. The wedge-like surface 92 on the release block 90 pushes the top end of the lock plate 70 frontward to release the power spring 50, when the handle 20 is pressed low enough. When the handle 20 is released, a push-up spring 95 will push up the release block 90, so that the lock-plate push spring 77 can push the top end of the lock plate 70 backward to lock the power spring 50. The lock plate 70 is resting at an angle toward the rear end of the housing body 10, so that the lock plate 70 will not interfere with the power spring 50 when it is released and slams down. When the handle 20 is released, the return spring 55 pushes up the power spring 50, overcoming the urge of the lock-plate push spring 77, to the resting position as shown in FIG. 1.

Referring again to FIG. 1, a staple feeding track is formed at the bottom of the housing body 10, which comprises a staple retention panel 40, a sliding block 45 pulled forward by a drag spring 42 for pushing a staple magazine toward the front end of the staple feeding track. The sliding block 45 is confined by a pair of horizontal slots 47 formed on each internal side walls of the feeding track. In the resting position, the spring powered stapler sits on a base plate 30. A base spring 32 urges the base plate 30 away from the housing body 10, so that a stack of paper or other objects can be inserted under the housing body to be stapled.

Figure 2A:
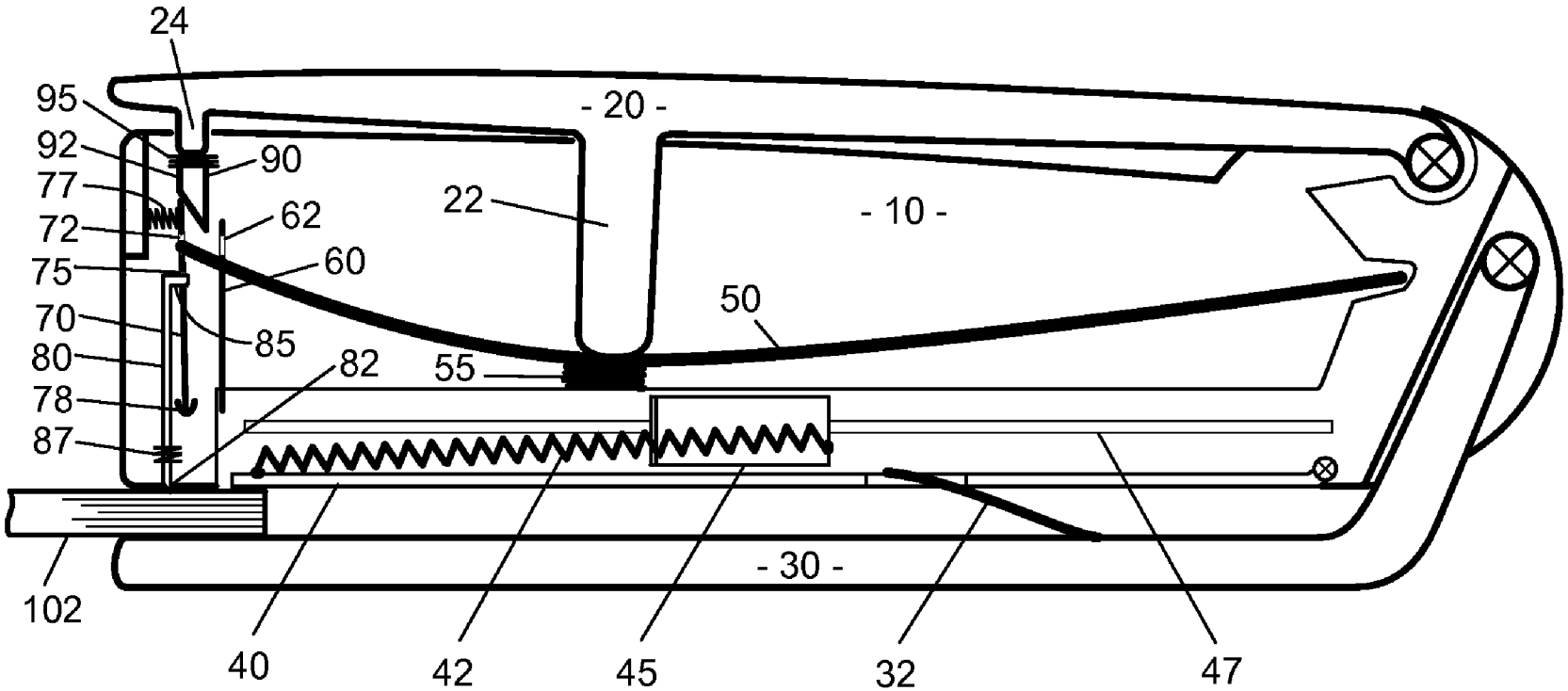
FIG. 2A is a side partial sectional view of the spring powered stapler of FIG. 1 just prior to ejecting a staple.

FIG. 2A is a side partial sectional view of the spring powered stapler of FIG. 1 just prior to ejecting a staple. A stack of paper 102 is place underneath the housing body 10 and pushes the safety pin 80 to an upper position where a safety-pin protruding member 85 is inserted into the safety-pin hole 75 on the lock plate 70. Therefore, the lock plate 70 can move freely frontward to allow the power spring 50 to be released.

Figure 2B:
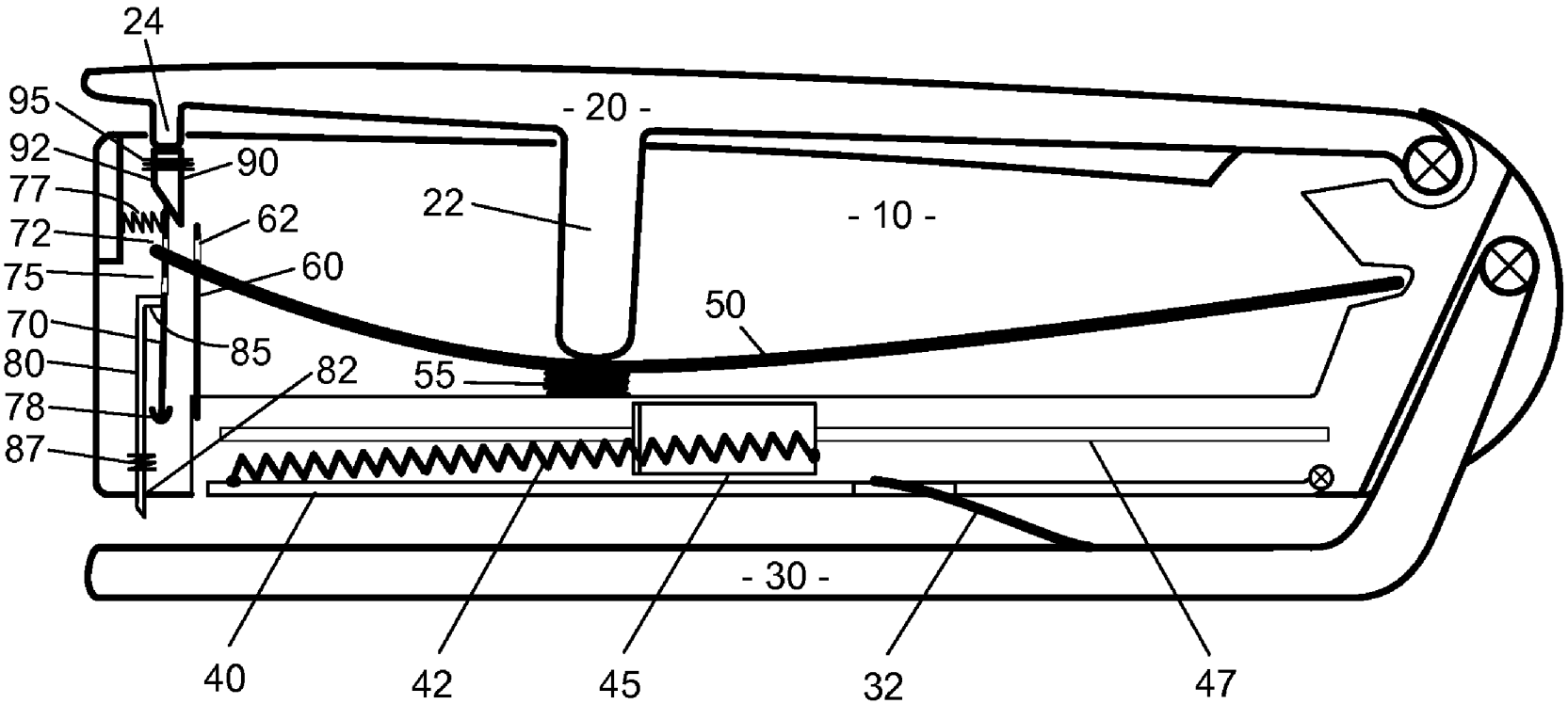

FIG. 2B is a side partial sectional view of the spring powered stapler of FIG. 1 which is prevented from ejecting a staple when a safety pin 80 is not pushed in. In this case, there isn't any object underneath the housing body 10 to push in the safety pin 80. If the power spring 50 is allowed to release and expel a staple, the staple may be shot out at a very fast speed and cause safety concerns. The present invention employs the safety pin 80 to prevent this from happening. When there is no object placed beneath a bottom tip 82 of the safety pin 80, a safety spring 87 urges the safety pin 80 to a lower position where the safety-pin protruding member 85 is misaligned with the safety-pin hole 75 on the lock plate. Instead of inserted into the safety-pin hole 75, the safety-pin protruding member 85 comes into contact with the wall of the lock plate 70 which is made of a rigid material, such as steel. The safety pin 80 is limited by a channel (not shown) formed as part of the housing body 10 to slide only vertically. As a result, in this case, the lock plate 70 cannot be pushed frontward to release the power spring 50.

Figure 3:
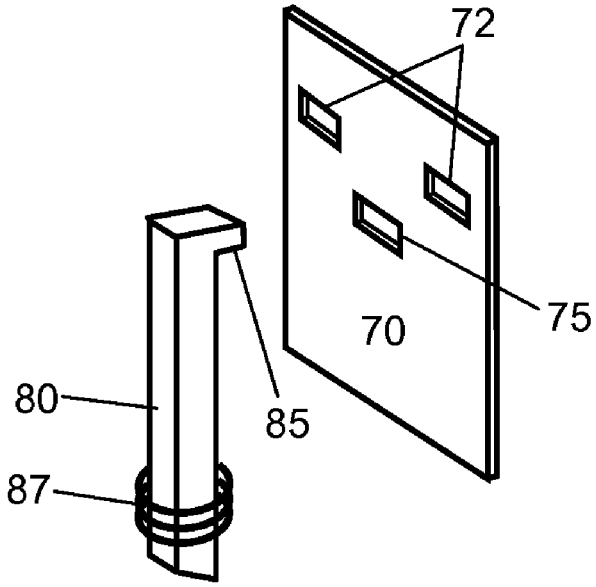
FIG. 3 is a perspective view of key elements of the safety apparatus for the spring powered stapler of FIG. 1.

FIG. 3 is a perspective view of key elements of the safety apparatus for the spring powered stapler of FIG. 1. The key elements are the safety pin 80 and the lock plate 70. The safety spring 87 urges the safety pin to the lower position. The safety-pin hole 75 has a right dimension to accommodate the safety-pin protruding member 85. There are two locking holes 72 for engaging the power spring 50. The locking holes 72 and the safety-pin hole 75 are not vertically aligned, so that the front end of the power spring 50 will not insert in the safety-pin hole 75 when the power spring 50 is release and slide downward. Both the lock plate 70 and the safety pin 80 are made of rigid materials, such as steel.

Figure 4:
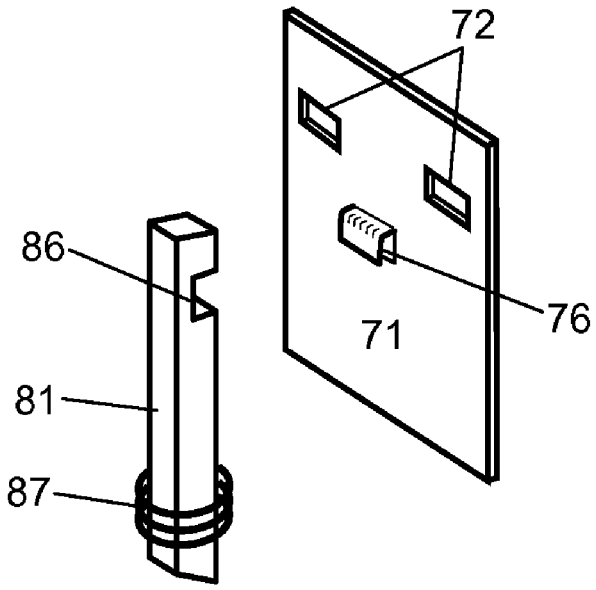
FIG. 4 is a perspective view of key elements of an alternative safety apparatus for the spring powered stapler of FIG. 1.

FIG. 4 is a perspective view of key elements of an alternative safety apparatus for the spring powered stapler of FIG. 1. The alternative safety apparatus comprises a lock plate 71 and a safety pin 81. The lock plate 71 is identical to the lock plate 70 of FIG. 3 except a protruding member 76 on the lock plate 71 takes the place of the safety-pin hole 75 on the lock plate 70 of FIG. 1. Correspondingly, instead of having a protruding member 85 on the safety pin 80 of FIG. 3, the safety pin 81 has a concave member 86 thereon. When the safety pin 81 is in a lower position, the concave member 86 is not aligned with the protruding member 76 on the lock plate 71, and the shaft of the safety pin 81 comes into contact with the protruding member 76 on the lock plate 71, and prevent the same from moving frontward to release the power spring 50. When the safety pin 81 is in an upper position, the concave member 86 becomes aligned with the protruding member 76 on the lock plate 71, and allows the lock plate 71 to move frontward to release the power spring 50.

The above illustrations provide many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A safety apparatus for a stapler having a power spring for storing energy as well as urging a driving blade to expel a staple upon releasing the stored energy, the safety apparatus comprising:

a lock plate holding up the power spring for storing energy when in a first position, and releasing the power spring when the lock plate being moved substantially horizontally to a second position;

a safety pin substantially vertically movable between a third and fourth position, the safety pin being in the third position when the stapler is not pressed against an object for being stapled, and the safety pin being in the fourth position when the stapler is pressed against an object for being stapled;

an opening on the lock plate for accommodating a protruding member on the safety pin, wherein when the safety pin is in the third position, the second opening on the lock plate and the protruding member on the safety pin are not aligned with each other, and the protruding member on the safety pin stops the lock plate from being moved to the second position, wherein when the safety pin is in the fourth position, the protruding member on the safety pin is inserted into the second opening on the lock plate to allow the lock plate to be moved to the fourth position; and a first spring for urging the safety pin to the fourth position, wherein when in the third position, the safety pin stops the lock plate from being moved to the second position, and when in the fourth position, the safety pin makes room for the lock plate to be moved to the second position.

2. The safety apparatus of claim 1 further comprising a second spring for urging the lock plate to the first position.

3. A safety apparatus for a stapler having a power spring for storing energy as well as urging a driving blade to expel a staple upon releasing the stored energy, the safety apparatus comprising:

a lock plate holding up the power spring for storing energy when in a first position, and releasing the power spring when the lock plate being moved substantially horizontally to a second position;

a safety pin substantially vertically movable between a third and fourth position, the safety pin being in the third position when the stapler is not pressed against an object for being stapled, and the safety pin being in the fourth position when the stapler is pressed against an object for being stapled;

a concave member on the safety pin for accommodating a protruding member on the lock plate, wherein when the safety pin is in the third position, the concave member on the safety pin and the protruding member on the lock plate are not aligned with each other, and the protruding member on the lock plate and the safety pin stop the lock plate from being moved to the second position, wherein when the safety pin is in the fourth position, the protruding member on the lock plate is inserted into the concave member on safety pin to allow the lock plate to be moved to the fourth position; and a first spring for urging the safety pin to the fourth position, wherein when in the third position, the safety pin stops the lock plate from being moved to the second position, and when in the fourth position, the safety pin makes room for the lock plate to be moved to the second position.

4. A safety apparatus for a stapler having a power spring for storing energy as well as urging a driving blade to expel a staple upon releasing the stored energy, the safety apparatus comprising:

a lock plate having a top section holding up the power spring for storing energy when the top section of the lock plate being in a first position, and releasing the power spring when the top section of the lock plate being moved substantially horizontally to a second position;

a first spring for urging the top section of the lock plate to the first position;

a safety pin substantially vertically movable between a third and fourth position, the safety pin being in the third position when the stapler is not pressed against an object for being stapled, and the safety pin being in the fourth position when the stapler is pressed against an object for being stapled; and a second spring for urging the safety pin to the fourth position, wherein when in the third position, the safety pin stops the lock plate from being moved to the second position and when in the fourth position, the safety pin makes room for the lock plate to be moved to the second position.

5. The safety apparatus of claim 4 further comprising at least one first opening on the top section of the lock plate for engaging the power spring.

6. The safety apparatus of claim 4 further comprising a second opening on the lock plate for accommodating a protruding member on the safety pin, wherein when the safety pin is in the third position, the second opening on the lock plate and the protruding member on the safety pin are not aligned with each other, and the protruding member on the safety pin stops the lock plate from being moved to the second position, wherein when the safety pin is in the fourth position, the protruding member on the safety pin is inserted into the second opening on the lock plate to allow the lock plate to be moved to the fourth position.

7. The safety apparatus of claim 4 further comprising a concave member on the safety pin for accommodating a protruding member on the lock plate, wherein when the safety pin is in the third position, the concave member on the safety pin and the protruding member on the lock plate are not aligned with each other, and the protruding member on the lock plate and the safety pin stop the lock plate from being moved to the second position, wherein when the safety pin is in the fourth position, the protruding member on the lock plate is inserted into the concave member on safety pin to allow the lock plate to be moved to the fourth position.

8. The safety apparatus of claim 4, wherein the lock plate is made of steel.

9. The safety apparatus of claim 4, wherein the power spring stores energy when the front and rear end of the power spring are held in a upper position while a section between the front and rear end of the power spring is bent down.

10. A safety apparatus for a spring powered stapler, the safety apparatus comprising:

a power spring for storing energy when the front and rear end of the power spring is held in a upper position while a section between the front and rear end of the power spring is bent down;

a lock plate having a top section holding up the front end of the power spring for storing energy when the top section of the lock plate being in a first position, and releasing the power spring when the top section of the lock plate being moved substantially horizontally to a second position;

a first spring for urging the top section of the lock plate to the first position;

a safety pin substantially vertically movable between a third and fourth position, the safety pin being in the third position when the stapler is not pressed against an object for being stapled, and the safety pin being in the fourth position when the stapler is pressed against an object for being stapled; and a second spring for urging the safety pin to the fourth position, wherein when in the third position, the safety pin stops the lock plate from being moved to the second position and when in the fourth position, the safety pin makes room for the lock plate to be moved to the second position.

11. The safety apparatus of claim 10 further comprising at least one first opening on the top section of the lock plate for engaging the power spring.

12. The safety apparatus of claim 10 further comprising a second opening on the lock plate for accommodating a protruding member on the safety pin, wherein when the safety pin is in the third position, the second opening on the lock plate and the protruding member on the safety pin are not aligned with each other, and the protruding member on the safety pin stops the lock plate from being moved to the second position, wherein when the safety pin is in the fourth position, the protruding member on the safety pin is inserted into the second opening on the lock plate to allow the lock plate to be moved to the fourth position.

13. The safety apparatus of claim 10 further comprising a concave member on the safety pin for accommodating a protruding member on the lock plate, wherein when the safety pin is in the third position, the concave member on the safety pin and the protruding member on the lock plate are not aligned with each other, and the protruding member on the lock plate and the safety pin stop the lock plate from being moved to the second position, wherein when the safety pin is in the fourth position, the protruding member on the lock plate is inserted into the concave member on safety pin to allow the lock plate to be moved to the fourth position.

14. The safety apparatus of claim 1, wherein the lock plate is made of steel.

* * * * *